US011110313B2

(12) United States Patent
Gore

(10) Patent No.: US 11,110,313 B2
(45) Date of Patent: Sep. 7, 2021

(54) BOX RACK WITH FUNCTIONAL TRAINING DEVICES

(71) Applicant: Recreation Supply, Inc., Lewis Center, OH (US)

(72) Inventor: Alan Gore, Lewis Center, OH (US)

(73) Assignee: Recreation Supply, Inc., Lewis Center, OH (US)

( * ) Notice: Subject to any disclaimer, the term of this patent is extended or adjusted under 35 U.S.C. 154(b) by 0 days.

(21) Appl. No.: 16/116,469

(22) Filed: Aug. 29, 2018

(65) Prior Publication Data

US 2020/0069988 A1 Mar. 5, 2020

(51) Int. Cl.
*A63B 21/078* (2006.01)
*A63B 21/00* (2006.01)

(52) U.S. Cl.
CPC .. *A63B 21/00047* (2013.01); *A63B 21/00065* (2013.01); *A63B 21/0783* (2015.10); *A63B 21/156* (2013.01); *A63B 21/4035* (2015.10); *A63B 2225/10* (2013.01)

(58) Field of Classification Search
CPC ..... A63B 21/00047; A63B 21/156; A63B 21/00065; A63B 2225/10; A63B 21/4035
See application file for complete search history.

(56) References Cited

U.S. PATENT DOCUMENTS 5,215,510 A 6/1993 Baran
5,669,859 A 9/1997 Liggett et al.
6,394,935 B1 * 5/2002 Lake ..... A63B 21/154 482/93
7,131,937 B2 11/2006 Skilken et al.
7,488,277 B1 2/2009 Knapp
7,654,942 B1 * 2/2010 Batea ..... A63B 21/156 482/135
7,666,124 B2 2/2010 Vaes
7,837,600 B1 11/2010 Habing
8,870,718 B2 10/2014 Habing
9,050,496 B2 6/2015 Towley, III et al.
2001/0034290 A1 * 10/2001 Tolles ..... A63B 21/152 482/99
2002/0091043 A1 * 7/2002 Rexach ..... A63B 21/0628 482/98
2002/0147086 A1 10/2002 Walsh
2008/0287270 A1 * 11/2008 Carter ..... A63B 21/154 482/99

(Continued)

OTHER PUBLICATIONS

Bodycraft, F430 Power Rack for Free Weights, 1999, pp. 1-9, USA.

(Continued)

*Primary Examiner* — Sundhara M Ganesan
(74) *Attorney, Agent, or Firm* — Standley Law Group LLP

(57) ABSTRACT

An exercise machine may include a box rack and at least one functional training device secured to the box rack and connected to at least one resistance device. The box rack may be comprised of a number of base members, vertical members, and upper members. A first functional training device may be mounted to a first vertical member in a slidable arrangement. A second functional training device may be mounted to a second vertical member in a slidable arrangement. A third functional training device may be located on an upper portion of the box rack. A fourth functional training device may be located on a lower portion of the box rack.

20 Claims, 7 Drawing Sheets

(56) References Cited

U.S. PATENT DOCUMENTS

| | | | | |
|---|---|---|---|---|
| 2013/0184128 | A1* | 7/2013 | Towley, III | A63B 21/4045 482/102 |
| 2013/0203565 | A1* | 8/2013 | Floyd | A63B 21/0783 482/102 |
| 2013/0274075 | A1* | 10/2013 | Habing | A63B 23/03566 482/102 |
| 2014/0080685 | A1* | 3/2014 | Butler | A63B 21/062 482/102 |
| 2015/0246258 | A1* | 9/2015 | Hockridge | A63B 21/0628 482/99 |
| 2017/0007877 | A1* | 1/2017 | Leipheimer | A63B 21/0783 |
| 2017/0216656 | A1* | 8/2017 | Leipheimer | A63B 21/4029 |
| 2018/0200563 | A1* | 7/2018 | Hansen | F16B 2/10 |
| 2018/0353795 | A1* | 12/2018 | Ostmeyer | A63B 71/0054 |
| 2019/0240525 | A1* | 8/2019 | Leipheimer | A63B 21/075 |
| 2019/0336812 | A1* | 11/2019 | Leipheimer | A63B 23/03525 |

OTHER PUBLICATIONS

Bodycraft, Xpress, Sep. 9, 2020, pp. 1-2, USA https://web.archive.org/web/20040205104236/https://www.bodycraft.com.

Bodycraft, Xpress Strength Training System Instruction Manual, Sep. 11, 2020, pp. 1-13, Sunbury, Ohio USA.

FT2, Inspire Assembly & Operation Manual, Nov. 2012, pp. 1-33, Anaheim, CA USA.

Bodycraft, Xpress Pro, Sep. 11, 2020, pp. 1-2, Sunbury, Ohio USA.

* cited by examiner

BOX RACK WITH FUNCTIONAL TRAINING DEVICES

CROSS-REFERENCE TO RELATED APPLICATION

This application is makes no priority claim.

TECHNICAL FIELD

Exemplary embodiments of the present invention relate generally to a box rack with functional training devices.

BACKGROUND AND SUMMARY OF THE INVENTION

Box racks exist which facilitate the movement of a user through various exercises. Such box racks are generally rectangular cages which surround the user while the user moves a weight through one or more free weight exercises. Such box racks may facilitate, for example without limitation, lateral rows, dips, squats, bench press, and other exercises. One exemplary box rack is the F430 Power Rack from BODYCRAFT® available at https://www.bodycraft-.com/f430-power-rack.html.

In recent years, functional weight lifting exercises have increased in popularity. These exercises are intended to better emulate real world, practical uses of the muscles by engaging multiple muscle groups when performing an exercise instead of isolating a particular muscle or muscle group. One might compare a bicep curl, which is intended to engage the bicep, with a chin-up, which engages the biceps, shoulders, and back muscles, among others.

Users are increasingly seeking machines capable of providing the user with multiple exercise options. Therefore, what is needed is a box rack which incorporates functional training devices.

The present invention is a box rack which incorporates functional training devices. The box rack may comprise a number of vertical and horizontal members shaped into a substantially rectangular frame. The box rack may be configured to surround a user performing a free weight exercise. A first and second functional training device may each be mounted to one of the vertical members in a slidable arrangement. A third functional training device may be located on an upper portion of the box rack and configured to be pulled downward. A fourth functional training device may be located on a lower portion of the box rack and configured to be pulled outward or upward.

The first and third functional training devices may be connected to one another as well as a first resistance device by a first cable. The second and third functional training devices may be connected to one another as well as a second resistance device by a second cable. The first functional training device may be connected to the fourth functional training device by a third cable. The second functional training device may be connected to the fourth functional training device by a fourth cable.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
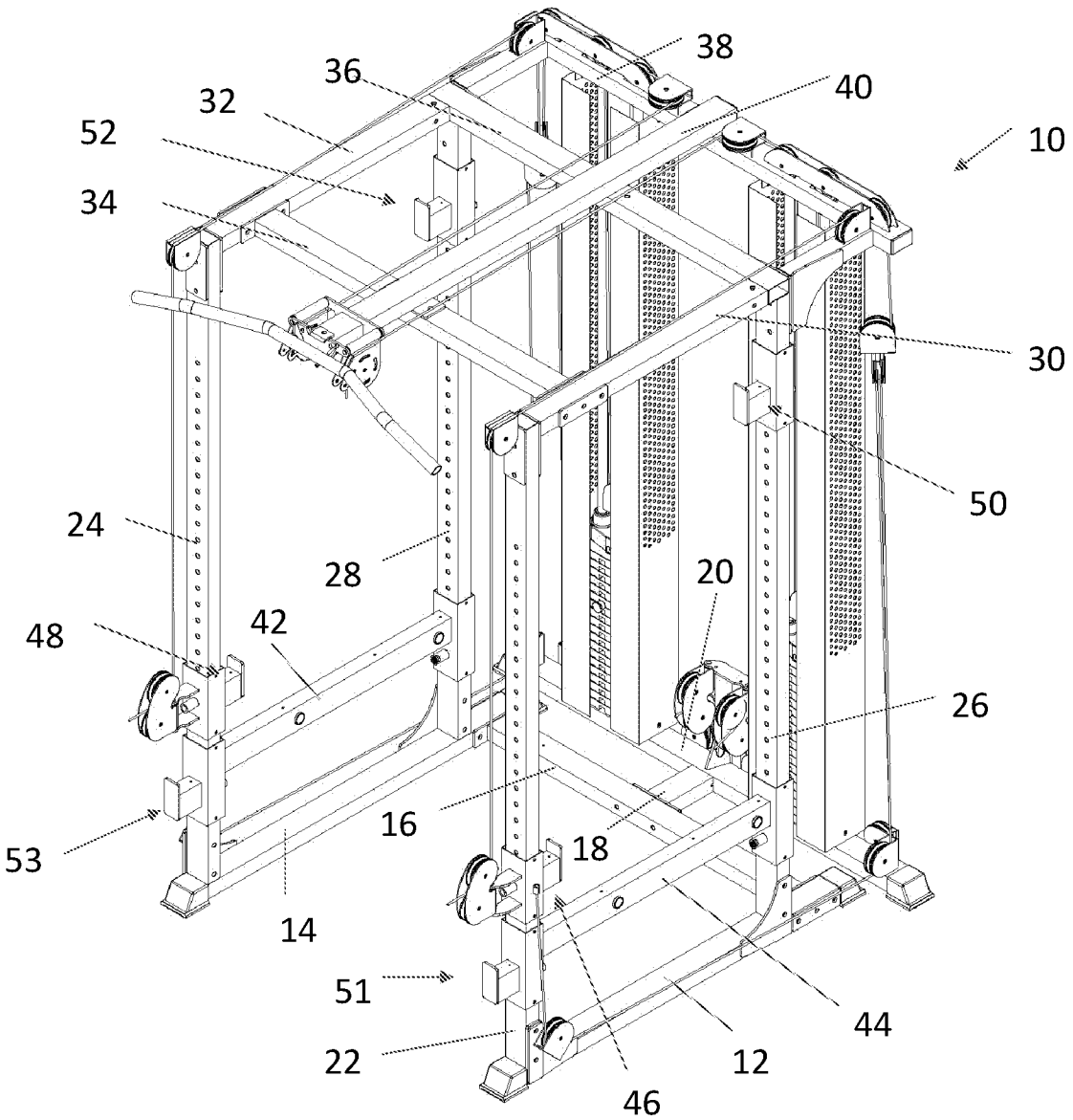
FIG. 1 a front perspective view of an exemplary exercise machine in accordance with the present invention.

FIG. 1 a front perspective view of an exemplary exercise machine 10. The exercise machine 10 may comprise a first base member 12, a second base member 14, and a third base member 16. The first base member 12 may be spaced apart from and extend substantially parallel with the second base member 14. The third base member 16 may extend between the first and second base members 12 and 14. In exemplary embodiments, the third base member 16 extends between distal ends of the first and second base members 12 and 14.

A fourth base member 20 may be spaced apart from and extend substantially parallel with the third base member 16. In exemplary embodiments, the fourth base member 20 is located behind the third base member 16. The fourth base member 20 may extend substantially the length of the third base member 16 and may extend therebeyond. A connector 18 may extend between the third base member 16 and the fourth base member 20. In exemplary embodiments, the connector may extend substantially perpendicular to the third base member 16 and the fourth base member 20.

A first vertical member 22 and a third vertical member 26 may extend substantially perpendicular from the first base member 12. In exemplary embodiments, the first and second vertical members 22 and 26 may extend substantially parallel with one another. The first vertical member 22 may extend from a proximal end of the first base member 12. The third vertical member 26 may extend from a distal end of the first base member 12. However, any location of the first and third vertical member 22 and 26 are contemplated.

Similarly, a second vertical member 24 and a fourth vertical member 28 may extend substantially perpendicular from the second base member 14. In exemplary embodiments, the second and fourth vertical members 24 and 28 may extend substantially parallel with one another. The second vertical member 24 may extend from a proximal end of the second base member 14. The fourth vertical member 28 may extend from a distal end of the second base member 14. However, any location of the second and fourth vertical member 24 and 28 are contemplated.

A first upper member 30 may extend between the first and third vertical member 22 and 26. In exemplary embodiments, the first upper member 30 may be connected to a distal end of the first and third vertical members 22 and 26. The first upper member 30 may extend beyond the third vertical member 26.

Similarly, a second upper member 32 may extend between the second and fourth vertical members 24 and 28. In exemplary embodiments, the second upper member 32 may be connected to a distal end of the second and fourth vertical members 24 and 28. The second upper member 32 may extend beyond the fourth vertical member 28.

A third upper member 34 may extend between the first upper member 30 and the second upper member 32. A fourth upper member 36 may extend between the first upper member 30 and the second upper member 32. A fifth upper member 38 may extend between the first upper member 30 and the second upper member 32. In exemplary embodiments, the third, fourth, and fifth upper members 34, 36, and 38 may be spaced apart from one another and extend substantially parallel to one another. A sixth upper member 40 may extend between the third, fourth, and fifth upper members 34, 36, and 38. In exemplary embodiments, the sixth upper member 40 may extend substantially parallel with the first and second upper members 30 and 32. The sixth upper member 40 may be located halfway between the first and second upper member 30 and 32, though such is not required. The sixth upper member 40 may extend along or on the third, fourth, and fifth upper members 34, 36, and 38.

At least the first, second, and third base members 12, 14, 16, the first, second, third, and fourth vertical members 22, 24, 26, and 28, and the first, second, third, and fourth upper members 30, 32, 34, and 36 may form a substantially rectangular cage. Stated another way, these components may form a box rack.

A first safety rail 42 may extend between the second and fourth vertical members 24 and 28. A second safety rail 44 may extend between the first and third vertical members 22 and 26. In exemplary embodiments, the first, second, third, and fourth vertical members 22, 24, 26, and 28 may comprise a series of apertures. The first and second safety rails 42 and 44 may be mounted to the respective vertical members 22, 24, 26, and 28 in a slidable arrangement. The first and second safety rails 42 and 44 may comprise removable pins configured to temporarily secure the first and second safety rails 42 and 44 at various vertical locations along the first, second, third, and fourth vertical members 22, 24, 26, and 28.

A first holding device 46 may be mounted to the first vertical member 22 in a slidable arrangement. A second holding device 48 may be mounted to the second vertical member 24 in a slidable arrangement. In exemplary embodiments, the first and second holding devices 46 and 48 may be hooks configured to receive a bar, such as a bar used to perform box squats, bench press, curls, rows, and the like. The first and second holding devices 46 and 48 may be mounted to the inside of the first and second vertical members 22 and 24, respectively, such that the respective holding device 46 and 48 faces the rear of the exercise machine 10. The first and second holding devices 46 and 48 may comprise pins configured to temporarily secure the first and second holding devices 46 and 48 at various vertical locations along the first and second vertical members 22 and 24 by engaging the apertures located in the first and second vertical members 22 and 24.

Similarly, a third holding device 50 may be mounted to the third vertical member 26 in a slidable arrangement. A fourth holding device 52 may be mounted to the fourth vertical member 28 in a slidable arrangement. In exemplary embodiments, the third and fourth holding devices 50 and 52 may be hooks configured to receive a bar, such as a bar used to perform box squats, bench press, curls, rows, and the like. The third and fourth holding devices 50 and 52 may be mounted to the inside of the third and fourth vertical members 26 and 28, respectively, such that the respective holding device 50 and 52 faces the front of the exercise machine 10. The second and third holding devices 50 and 52 may comprise pins configured to temporarily secure the second and third holding devices 50 and 52 at various vertical locations along the third and fourth vertical members 26 and 28 by engaging the apertures located in the third and fourth vertical members 26 and 28.

A fifth holding device 51 may be mounted to the first vertical member 22 in a slidable arrangement. A sixth holding device 53 may be mounted to the second vertical member 24 in a slidable arrangement. In exemplary embodiments, the fifth and sixth holding devices 51 and 53 may be hooks configured to receive a bar, such as a bar used to perform box squats, bench press, curls, rows, and the like. The fifth and sixth holding devices 46 and 48 may be mounted to the outside of the first and second vertical members 22 and 24, respectively, such that the respective holding device 51 and 53 faces the front of the exercise machine 10. The fifth and sixth holding devices 51 and 53 may comprise pins configured to temporarily secure the fifth and sixth holding devices 51 and 53 at various vertical locations along the first and second vertical members 22 and 24 by engaging the apertures located in the first and second vertical members 22 and 24.

The number and arrangement of the holding devices 46, 48, 50, 51, 52, and 53 is merely exemplary and is not intended to be limiting. Any number of holding devices 46, 48, 50, 51, 52, and 53 located along any or all of the first, second, third, and fourth vertical members 22, 24, 26, and 28 are contemplated.

Figure 2:
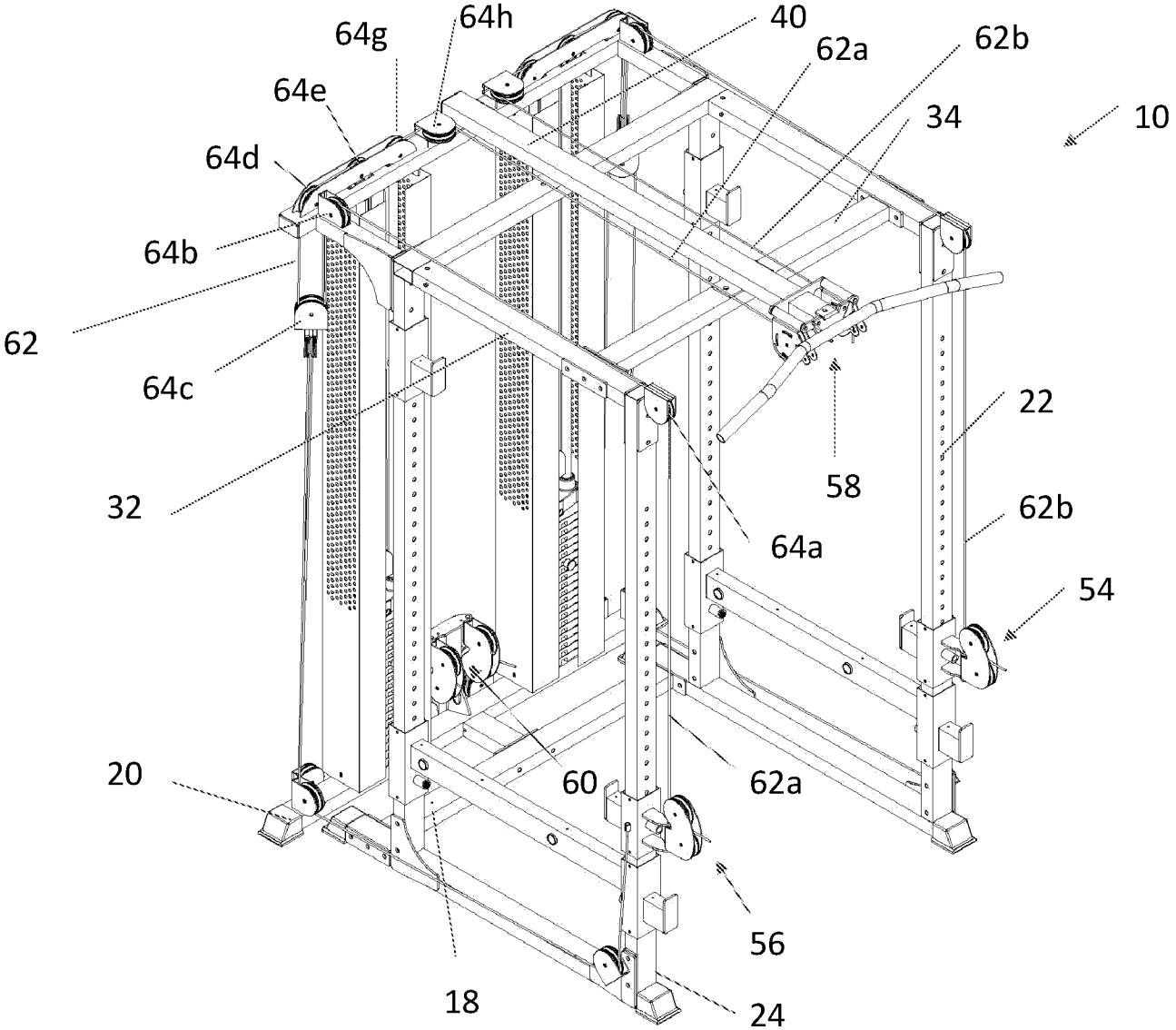
FIG. 2 is another front perspective view of the exercise machine of FIG. 1.

FIG. 2 is another front perspective view of the exercise machine 10. A first functional training device 54 may be mounted to the first vertical member 22 in a slidable arrangement. A second functional training device 56 may be mounted to the second vertical member 24 in a slidable arrangement. The first and second training devices 54 and 56 may comprise pins configured to temporarily secure the first and second training devices 54 and 56 at various vertical locations along the first and second vertical members 22 and 24 by engaging the apertures located in the first and second vertical members 22 and 24. In exemplary embodiments, the first functional training device 54 may be connected to, or integrally formed with, the first holding device 46, though such is not required. Similarly, in exemplary embodiments the second functional training device 56 may be connected to, or integrally formed with, the second holding device 48, though such is not required.

A third functional training device 58 may be mounted to a distal end of the sixth upper member 40. In other exemplary embodiments, the third functional training device 58 may be mounted to the third upper member 34. The third functional training device 58 may be a pull-down bar, though such is not required. Put more simply, the third functional training device 58 may be located on an upper portion of the box rack and configured to be pulled downward.

A fourth functional training device 60 may be mounted to the fourth base member 20. In other exemplary embodiments, the fourth functional training device 60 may be mounted to the third base member 16. The fourth functional training device 60 may be a rowing device, though such is not required. Put more simply, the fourth functional training device 60 may be located on a lower portion of the box rack and configured to be pulled upward or outward.

In exemplary embodiments, the functional training devices 54, 56, 58, and 60 may be cable pull devices. The functional training devices 54, 56, 58, and 60 may be fixed or may be configured for swiveling movement. The functional training devices 54, 56, 58, and 60 may comprise one or more pulleys configured to secure a cable 62*a*, 62*b*, 62*c*, or 62*d* and permit a user to pull on the cable 62*a*, 62*b*, 62*c*, or 62*d*, or attachment device (e.g., handle, bar, rope, etc.) connected thereto, and move through various exercises. As will be explained in greater detail herein, the cables 62*a*, 62*b*, 62*c*, and 62*d* may be connected to resistance devices 66*a* and 66*b*. The cables 62*a*, 62*b*, 62*c*, and 62*d*, may further comprise stoppers and/or attachment devices configured to prevent the cable 62*a*, 62*b*, 62*c*, or 62*d* from traveling beyond the respective functional training devices 54, 56, 58, and 60.

A first cable 62*a* may extend from the second functional training device 56 to a first resistance device 66*a* and on to the third functional training device 58. The first cable 62*a* may travel vertically upwards along the second vertical member 24 until engaging a first pulley 64*a*. The first pulley 64*a* may be located on or along the second vertical member 24 or the second upper member 32. In other exemplary embodiments, the first pulley 64*a* may be located on a member extending from the second upper member 32. The first cable 62*a* may then travel horizontally along the second upper member 32 until engaging the second pulley 64*b*. The second pulley 64*b* may be located on or along the second upper member 32. The first cable 62*a* may then travel vertically downwards until engaging a third pulley 64*c* and then reversing directions, traveling vertically upwards until engaging a fourth pulley 64*d*. As will be discussed in greater detail herein, the third pulley 64*c* may be attached to a tenth pulley 64*k* connected to a third cable 62*c*. The first cable 62*a* may then travel horizontally along the fifth upper member 38 before engaging a fifth pulley 64*e*. The first cable 62*a* may then travel vertically downwards until engaging a sixth pulley 64*f* located on, or otherwise connected to, the first resistance device 66*a*.

The first cable 62*a* may then reverse directions, traveling vertically upwards until engaging a seventh pulley 64*g*. The first cable 62*a* may then travel horizontally along the fifth upper member 38 until engaging an eighth pulley 64*h*. The fourth, fifth, seventh, and eighth pulleys 64*d*, 64, 64*g*, and 64*h* may be located on or along the fifth upper member 38. The first cable 62*a* may then travel horizontally along the sixth upper member 40 before terminating at or near the third functional training device 58.

A similar or identical arrangement may be located along the other side of the exercise machine 10 such that a second cable 62*b* travels between the first functional training device 54, the second resistance device 66*b*, and the third functional training device 58. It is notable that as the first and second cable 62*a* and 62*b* may both be connected to the third functional training device 58. A single attachment device of the third functional training device 58 may be connected to both the first and second cables 62*a* and 62*b* such that the first and second resistance device 66*a* and 66*b* are engaged when the attachment device is moved. In other exemplary embodiments, individual attachment devices of the third functional training device 58 may be connected to each of the first and second cables 62*a* and 62*b* separately such that the first and second resistance device 66*a* and 66*b* are separately engaged when the respective attachment device is moved.

Figure 3:
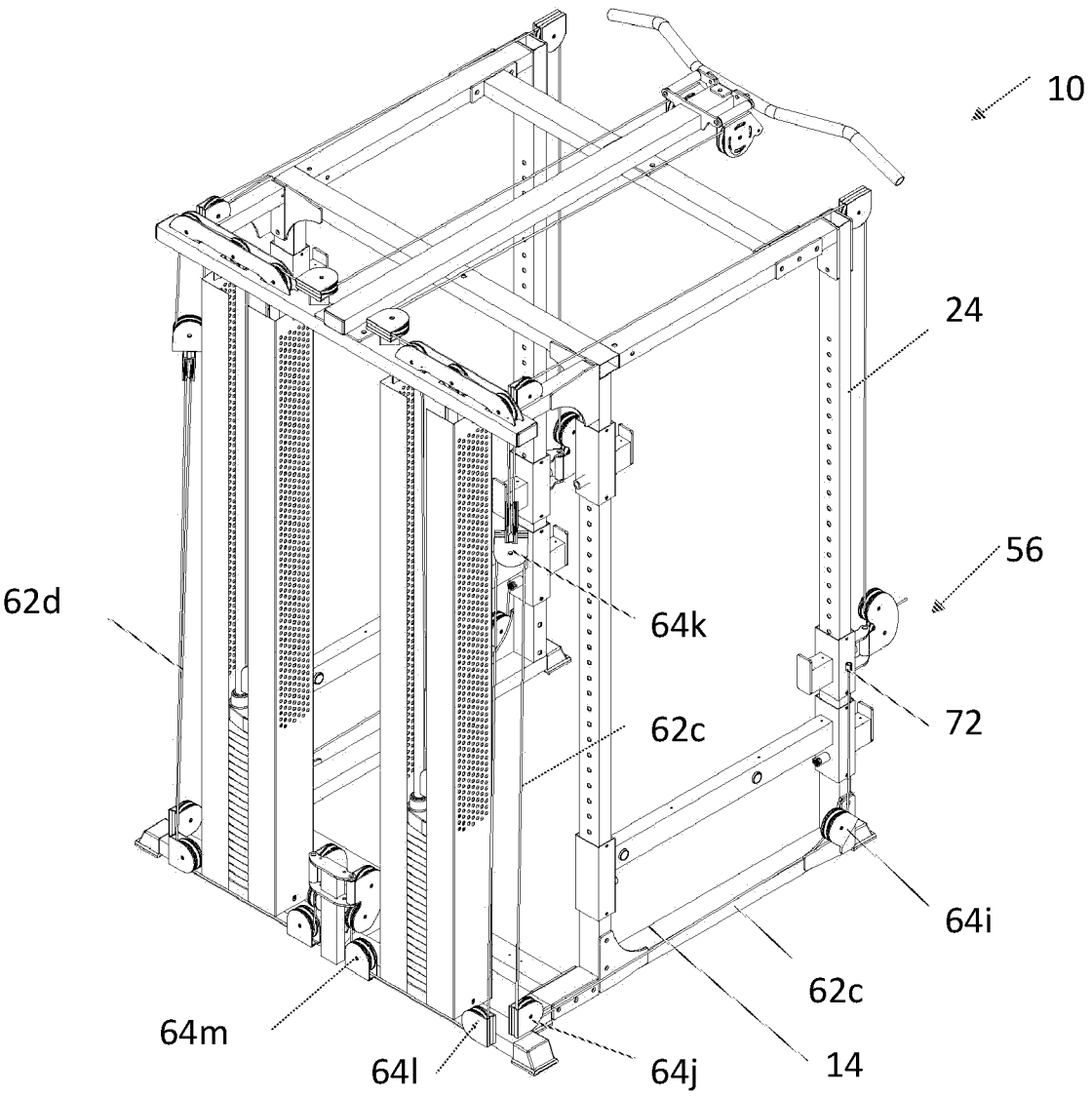
FIG. 3 is a rear perspective view of the exercise machine of FIG. 1.

FIG. 3 is a rear perspective view of the exercise machine 10. The third cable 62*c* may extend from a cable termination device 72 located on the second functional training device 56. The third cable 62*c* may extend vertically downward until engaging an eighth pulley 64*i*. The eighth pulley 64*i* may be located on or along the second vertical member 24 or the second base member 14. The third cable 62*c* may travel horizontally along the second base member 14 until engaging an ninth pulley 64*j*. The ninth pulley 64*j* may be located or on along the second base member 14 or the fourth base member 20. The third cable 62*c* may then travel vertically until engaging the tenth pulley 64*k*. The tenth pulley 64*k* may be attached to the third pulley 64*c*. The third cable 62*c* may then reverse directions and travel vertically downward until engaging an eleventh pulley 64*l*. The eleventh pulley 64*l* may be located on or along the fourth base member 20. The third cable may then travel horizontally along the fourth base member 20 before engaging a twelfth pulley 64*m*. The twelfth pulley 64*m* may be located on or along the fourth base member 20. The cable may then terminate at or near the fourth functional training device 60. The first resistance device 66*a* may be engaged by the connection of the third pulley 64*c* which may be attached to a tenth pulley 64*k* connected to a third cable 62*c*.

A similar or identical arrangement may be located along the other side of the exercise machine 10 such that a fourth cable 62*d* travels between a cable termination device 72 located on the first functional training device 54 and the fourth functional training device 60. It is notable that as the third and fourth cable 62*c* and 62*d* may be connected to the fourth functional training device 60, a single attachment device may be connected to both the third and fourth cables 62*c* and 62*d* such that the first and second resistance device 66*a* and 66*b* are engaged when the attachment device is moved. In other exemplary embodiments, individual attachment devices may be connected to each of the third and fourth cables 62*c* and 62*d* are separately engaged when the respective attachment device is moved.

Figure 4:
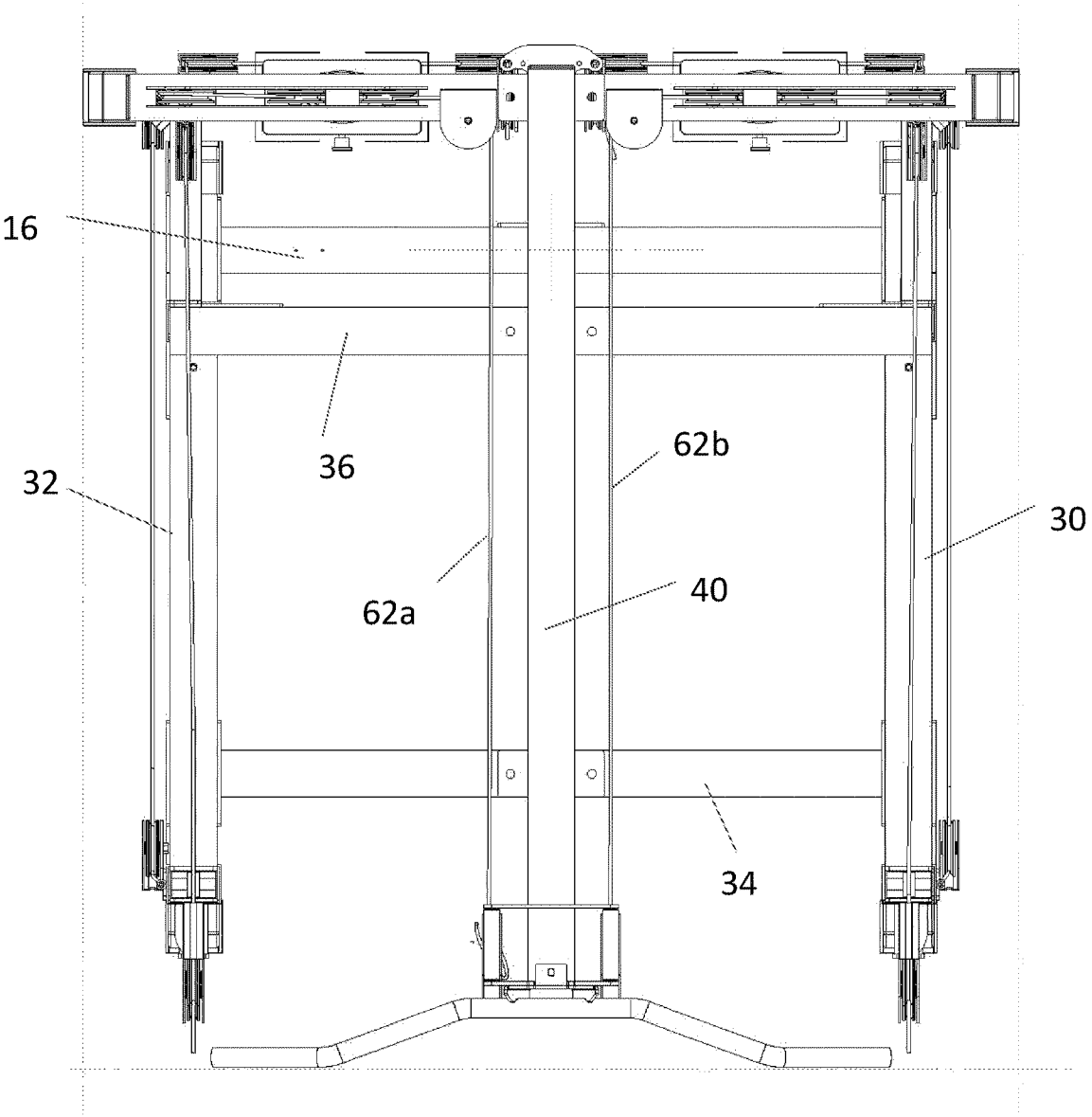
FIG. 4 is a top view of the exercise machine of FIG. 1.
Figure 5:
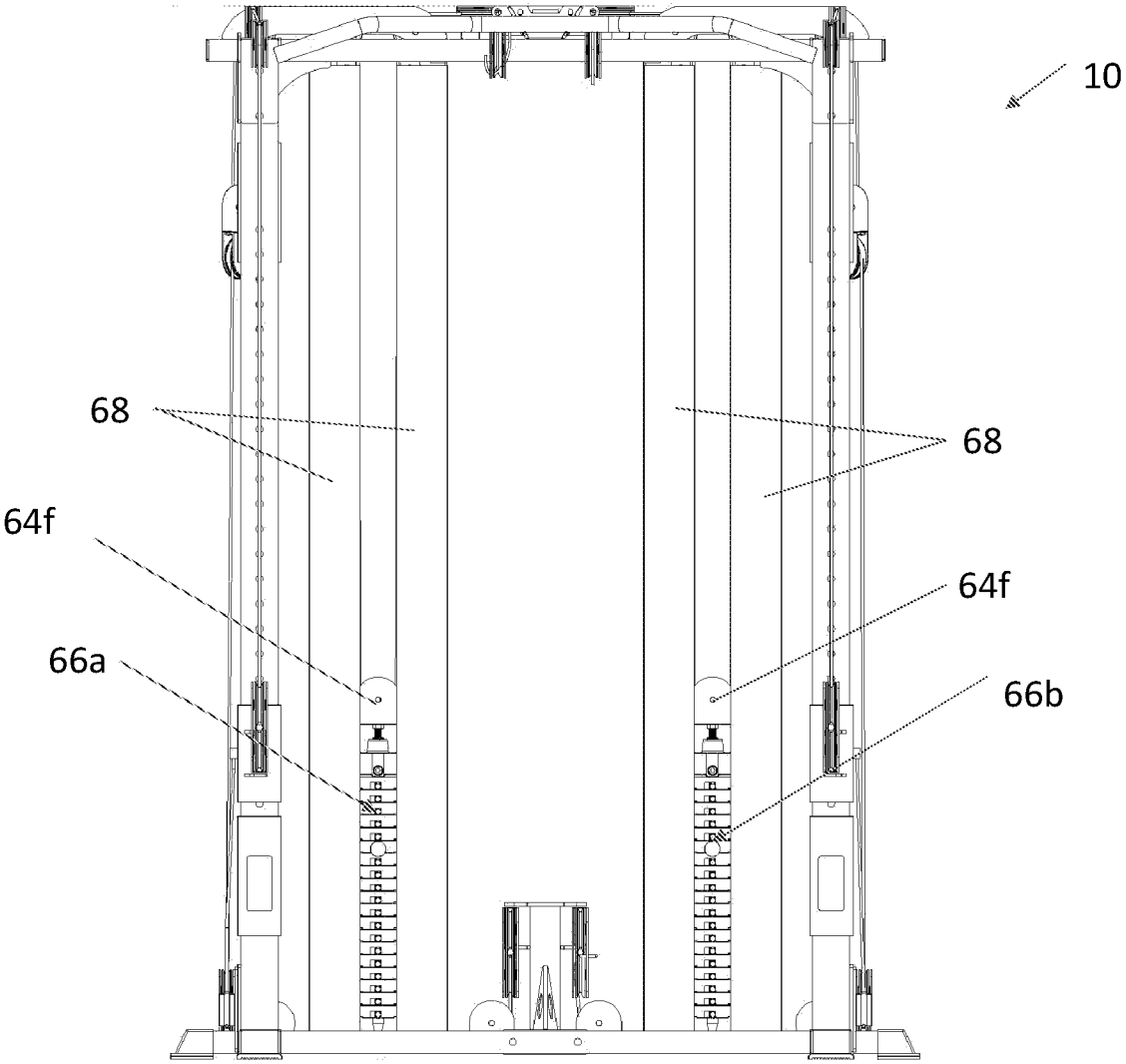
FIG. 5 is a front view of the exercise machine of FIG. 1.
Figure 6:
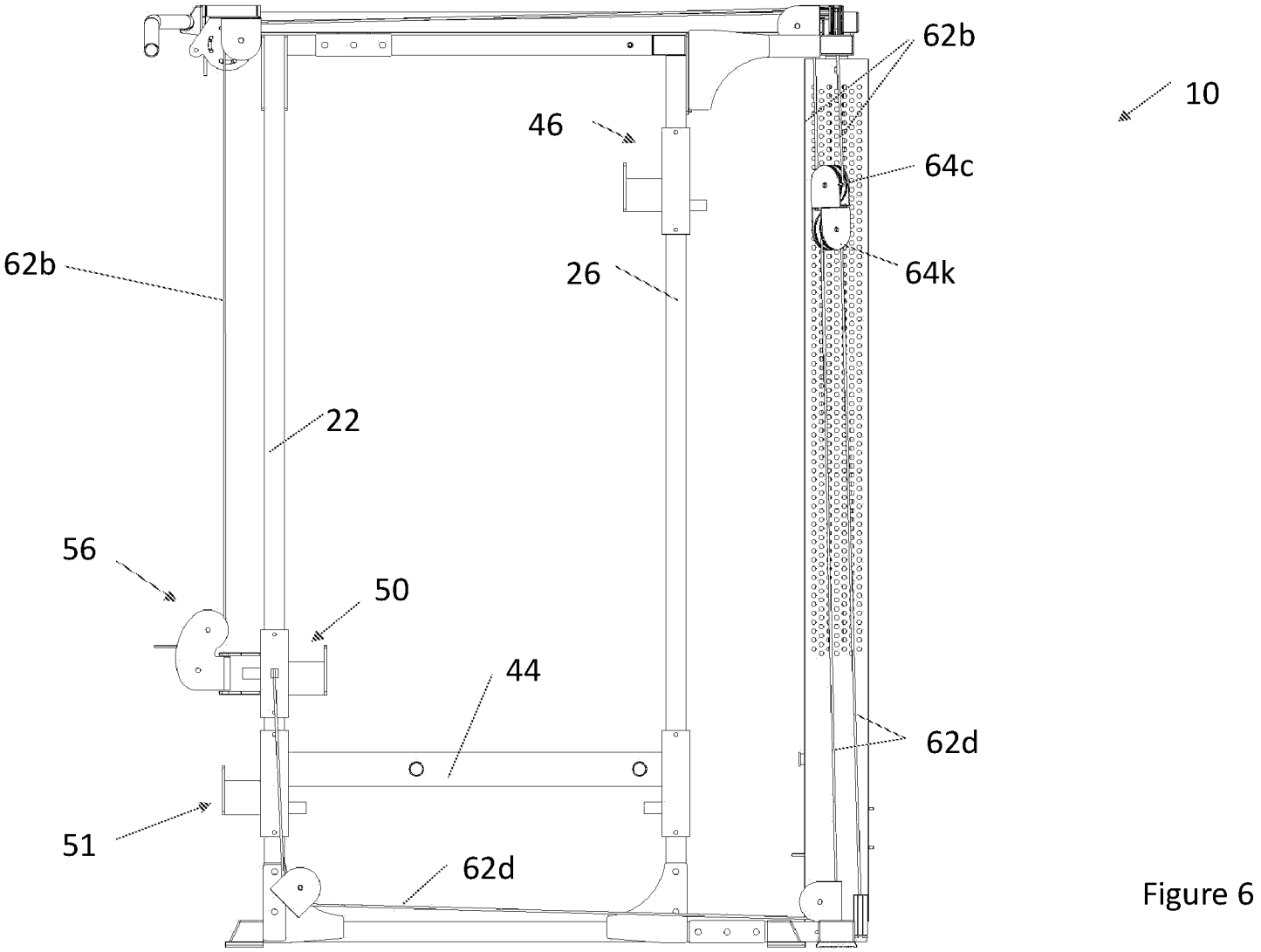
FIG. 6 is a right-side view of the exercise machine of FIG. 1.
Figure 7:
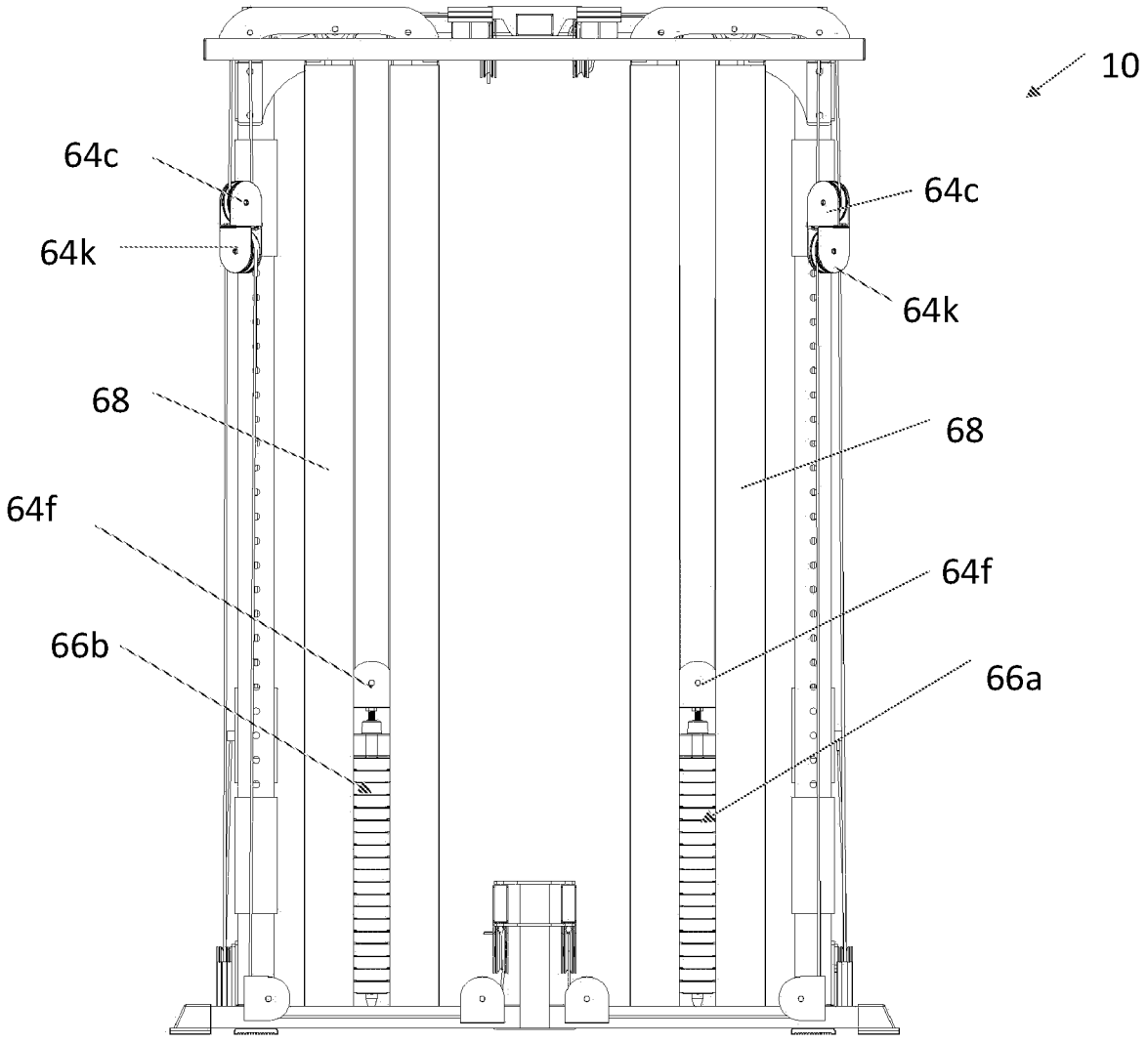
FIG. 7 is a rear view of the exercise machine of FIG. 1.

FIG. 4 is a top view of the exercise machine 10, FIG. 5 is a front view of the exercise machine 10, FIG. 6 is a right-side view of the exercise machine 10, and FIG. 7 is a rear view of the exercise machine 10. The resistance devices 66*a* and 66*b* may be a weight stack, weight plates (such as, without limitation, Olympic, or standard weight plates), an electric motor, a friction imparting mechanism, or the like. A shroud 68 may be partially or wholly surround each of the first and second resistance devices 66*a* and 66*b* together or separately.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. An exercise machine comprising:

a box rack comprising vertically extending members and one or more horizontally extending members forming a cage configured to surround a user performing barbell-based free weight exercises comprising squats and bench press;

one or more resistance devices located at a first side of said box rack;

one or more functional training devices, each comprising a carriage slideably secured to one of the vertically extending members located at a second side of said box rack, which opposes said first side, in a height adjustable fashion and a cable pull device attached to said carriage; and one or more cables connecting each of the one or more resistance devices to one of the one or more functional training devices so as to provide physical resistance to a user performing three-dimensional resistance-based exercise movements with any of said one or more functional training devices;

one or more pulleys, each mounted to said cage, wherein each of said one or more pulley are positioned to route each of said one or more cables outside of said cage and along at least one of said vertically extending members and said one or more horizontally extending members to permit user performance of said barbell-based free weight exercises comprising squats and bench press within said cage.

2. The exercise machine of claim 1 wherein:

said vertically extending members comprise:

a first front member;

a second front member;

a first rear member; and a second rear member; and said horizontally extending members comprise:

a first base member extending between a first front member and a first rear member;

a second base member extending between a second front member and a second rear member, wherein said second base member is spaced apart from and extends alongside the first base member;

a third base member extending between the first and second base members and between said first rear member and said second rear member; and one or more upper members extending between at least two of the vertically extending members.

3. The exercise machine of claim 2 further comprising:

a first one of said one or more functional training devices is mounted to said first front member; and a second one of said one or more functional training devices is mounted to said second front member.

4. The exercise machine of claim 3 further comprising:

an additional functional training device located at one of said one or more upper members, wherein said additional functional training device is configured to accommodate a pull-down bar; and one or more additional cables connecting to each of said one or more resistance devices to said additional functional training device.

5. The exercise machine of claim 4 wherein:

a fourth base member spaced apart from and extending substantially perpendicular with said third base member;

a connector extending between the third and fourth base members, wherein said fourth base member and said connector form part of said box rack and further defines said cage;

a second additional functional training device located at said fourth base member and configured to accommodate a rowing handle; and one or more further cables connecting each of said one or more resistance device to said additional functional training device.

6. The exercise machine of claim 5 wherein:

each of said cable pull devices, of said one or more functional training devices comprise a first pulley and a second pulley which are configured to swiveling movement relative to the carriage, wherein the first and second pulleys are positioned adjacent to one another to accommodate one of the one or more cables extending therebetween;

said additional functional training device is fixed to said one of said one or more upper members; and said second additional functional training device is fixed to said fourth base member.

7. The exercise machine of claim 6 wherein:

said one or more resistance devices comprise:

a first resistance device and a second resistance device;

said first one of said one or more functional devices is connected to said first resistance device but not said second resistance device;

said second one of said one or more functional devices is connected to said second resistance device but not said first resistance device;

said additional functional training device is connected to both of said first and second resistance devices; and said second additional functional training device is connected to both of said first and second resistance devices.

8. The exercise machine of claim 7 wherein:

said first and second resistance device each comprise a weight stack.

9. The exercise machine of claim 8 further comprising:

a first shroud at least partially surrounding the weight stack of said first resistance device; and a second shroud at least partially surrounding the weigh stack of said second resistance device.

10. The exercise machine of claim 3 further comprising:

a first number of vertically spaced holes in said first front member, wherein said carriage of said first one of said one or more functional training devices is configured to accommodate a removable pin for insertion through said carriage and one of said first number of vertically spaced holes; and a second number of vertically spaced holes in said second front member, wherein said carriage of said second one of said one or more functional training devices is configured to accommodate a removable pin for insertion through said carriage and one of said second number of vertically spaced holes.

11. The exercise machine of claim 2 further comprising:

a first holding device mounted to said first front member in a slidable arrangement; and a second holding device mounted to said second front member of said in a slidable arrangement, wherein said first and second holding devices are configured to receive and support said barbell.

12. The exercise machine of claim 11 further comprising:

a first safety rail mounted to each of said first front member and said first rear member in a slidable arrangement; and a second safety rail mounted to each of said second front member and said second rear member in a sliding arrangement, wherein said first and second safety rails are configured to prevent the barbell from traveling past said first and second safety rails when dropped.

13. The exercise machine of claim 1 wherein:

said box rack comprises a full rack.

14. The exercise machine of claim 1 further comprising:

one or more stopper or attachment mechanisms, each located at a portion of a respective one of said one more cables extending through and beyond a respective one of said cable pull devices of a respective one of said one or more functional training devices, wherein each of said one or more stopper or attachment mechanisms is configured to prevent said portion of said respective one of said one of said one or more cables from retracting past said respective one of said cable pull devices.

15. The exercise machine of claim 1 further comprising:

one or more holding devices, each located at a respective one of said one or more functional training devices on an opposing side of a respective one of said carriages from a respective one of said cable pull devices of said respective one of said one or more functional training devices, wherein each of said one or more holding devices are configured to temporarily secure a portion of said barbell.

16. An exercise machine comprising:

a box rack configured to facilitate performance of various barbell-based free weight exercise movements, said box rack comprising:

a first vertical member located at a front side of said box rack;

a second vertical member located at said front side of said box rack;

a third vertical member located at a rear side of said box rack opposing said first side;

a fourth vertical member located at said rear side of said box rack; and a number of horizontal members extending between at least two of the first, second, third, and fourth vertical members;

wherein said first, second, third, and fourth vertical members and the horizontal members form a framework defining a cage forming a cuboid shaped open space for user performance of said various barbell exercises with an Olympic sized barbell such that ends of said Olympic sized barbell extend outside of a left side and a right side of said box rack while performing said various barbell exercises using said Olympic sized barbell within said cage;

a first functional training device comprising a first cable pull device having adjacent pulleys and a first carriage mounted to said first vertical member in a slidable fashion for selective securement at any of a number of vertical positions along said first vertical member and;

a second functional training device comprising a second cable pull device having adjacent pulleys and a second carriage mounted to said second vertical member in a slideable fashion for selective securement at any of a number of vertical positions along said second vertical member;

a first and second weight stacks, each associated with at least one of said third and fourth vertical members of said box rack;

a first set of one or more cables connecting said first weight stack to said first cable pull device, wherein at least one of said cables in said first set of one or more cables comprises a distal portion which extends though said adjacent pulleys of said first cable pull device and comprises a first stopper or attachment mechanism positioned beyond said adjacent pulleys of said first cable pull device to prevent said at least one of said cables in said first set of one or more cables from retracting past said adjacent pulleys of said first cable pull device; and a second set of one or more cables connecting said second weight stack to said second cable pull device, wherein at least one of said cables in said second set of one or more cables comprises a distal portion which extends through said adjacent pulleys of said second cable pull device and comprises a second stopper or attachment mechanism positioned beyond said adjacent pulleys of said second cable pull device to prevent said at least one of said cables in said second set of one or more cables from retracting past said adjacent pulleys of said second cable pull device;

wherein each of said one or more cables in said first and second set of one or more cables extend along members of said box rack and such that said left side and said right side of said box rack are unobstructed to facilitate performance of said various barbell exercises with said Olympic sized barbell within said cage.

17. The exercise machine of claim 16 further comprising:

a third functional training device located on an upper portion of the box rack and configured to be pulled outward or downward by said user; and a third set of one or more cables connecting both of said first and second weight stacks to said third functional training device.

18. The exercise machine of claim 17 further comprising:

a fourth functional training device located on a lower portion of the box rack and configured to be pulled upward or outward by said user; and a fourth set of one or more cables connecting both of said first and second weight stacks to said fourth functional training device.

19. The exercise machine of claim 16 wherein:

said box rack comprises a full power rack.

20. An exercise apparatus comprising:

a full power rack comprising a number of vertically extending members and a number of horizontally extending members, said vertically and horizontally extending members forming a cage having open sides for a user to perform various barbell-based free weight exercise movements comprising squats while ends of said barbell extend though said open sides of said cage;

a weight stack associated with said full power rack;

a cable pull device slidably attached to one of a number of the vertically extending members forming said cage in a manner which permits temporary securement of said cable pull device at a number of vertical positions along said one of said number of the vertically extending members;

one or more cables connecting said weight stack and to said cable pull device, wherein said cable pull device and said one or more cables are configured to facilitate the performance of various three-dimensional resistance-based exercise movements, wherein said one ore more cables extend along said one of said number of vertically extending members and at least one of said number of horizontally extending members such that the open side of the cage are unobstructed for the user to perform said various barbell-based free weight exercise movements while said ends of said barbell extend through said open sides of said cage; and a stopper or attachment mechanism located on a portion of one of said one more cables extending through and beyond said cable pull device to prevent said portion of said one or more cables from retracting past said cable pull device.

* * * * *